US005225004A

United States Patent [19]

O'Handley et al.

[11] Patent Number: 5,225,004

[45] Date of Patent: Jul. 6, 1993

[54] BULK RAPIDLY SOLIFIDIED MAGNETIC MATERIALS

[75] Inventors: Robert C. O'Handley, Andover; Nicholas J. Grant, Winchester, both of Mass.; Yutaka Hara, Tokyo, Japan; Enrique J. Lavernia, Tustin, Calif.; Tetsuji Harada, Ageo, Japan; Teiichi Ando, Watertown, Mass.

[73] Assignee: Massachusetts Institute of Technology, Cambridge, Mass.

[21] Appl. No.: 694,002

[22] Filed: Apr. 30, 1991

Related U.S. Application Data

[63] Continuation-in-part of Ser. No. 629,077, Dec. 17, 1990, which is a continuation of Ser. No. 922,730, Oct. 24, 1986, abandoned, which is a continuation of Ser. No. 766,051, Aug. 15, 1985, abandoned.

[51] Int. Cl.[5] ..... H01F 1/02

[52] U.S. Cl. ..... 148/101; 148/538; 148/540; 148/555; 164/463; 164/479

[58] Field of Search ..... 148/101, 538, 540, 555; 164/463, 479

[56] References Cited

U.S. PATENT DOCUMENTS

| | | | |
|---|---|---|---|
| 4,496,395 | 1/1985 | Croat | 148/301 |
| 4,585,473 | 4/1986 | Narasimhan et al. | 148/101 |
| 4,994,109 | 2/1991 | Willman et al. | 148/101 |

*Primary Examiner*—John P. Sheehan
*Attorney, Agent, or Firm*—Bruce F. Jacobs

[57] ABSTRACT

Bulk rapidly solidified magnetic materials having a density of greater than 90%, a thickness of at least 250 microns, and preferably a low oxygen content, are produced by a liquid dynamic compaction process which, depending upon the chosen operating conditions, can yield materials ranging from crystalline to partially crystalline to amorphous. The materials so produced are directly useful, i.e. without having to be reduced to a powder and consolidated into a shape, to produce permanent magnets. When the materials are amorphous, they can be directly used as soft magnetic materials and for other purposes

17 Claims, 8 Drawing Sheets

BULK RAPIDLY SOLIFIDIED MAGNETIC MATERIALS

U.S. GOVERNMENT RIGHTS

The U.S. government has rights in this invention by virtue of U.S. Army Research Office Contract No. DAAG-84-K-0171.

CROSS REFERENCE TO RELATED APPLICATIONS

This application is a continuation-in-part of U.S. Ser. No. 07/629,077, filed Dec. 17, 1990, which is a continuation of U.S. Ser. No. 06/922,730, filed Oct. 24, 1986, now abandoned, which is a continuation of U.S. Ser. No. 06/766,051, filed Aug. 15, 1985, now abandoned.

BACKGROUND OF THE INVENTION

The present invention relates to the preparation of bulk materials which may range from being completely amorphous to completely crystalline. The bulk materials are produced by a rapid solidification process, specifically liquid dynamic compaction, in which the different products are produced by varying the operating conditions. Generally the process entails delivering a stream of a molten metal alloy into an inert gas atmosphere and atomizing it with an inert gas by means of one or more ultrasonic inert gas jets. The atomized alloy droplets impact a high heat capacity substrate, preferably liquid cooled, to form "splats" which build up upon themselves to form the desired bulk rapidly solidified material. The resultant bulk materials, be they amorphous or crystalline, generally contain little or no oxygen greater than that in the initial starting materials used to form the molten metal alloy. The term "bulk" is used herein to mean a product having a thickness of at least 250 microns, preferably at least about 1 mm, and more preferably at least about 3 mm. The bulk materials are thus directly prepared, i.e. without first crushing or comminuting the deposited material to form a powder and then reconsolidating that powder into a shaped bulk product. As a result, the initial microstructure of the deposited material, be it amorphous or crystalline, can be maintained in the final product. Alternatively, when some bulk amorphous materials are produced, they can be heat treated in a controllable manner to alter their structures and to convert them to bulk permanent magnets having superior magnetic properties.

Over the past few years, iron-neodymium-boron (Fe-Nd-B) alloys have attracted growing interest as high performance permanent magnets. High coercivities were reported for Fe-Nd films as early as 1978 by R. C. Taylor et al. in *J. Appl. Phys.* 49, 2885 (1978), but the level of interest and activity accelerated only after publication of work on high-energy product bulk materials: melt-spun Fe-Pr and Fe-Nd alloys by J. J. Croat in *Appl. Phys. Lett.* 37, 1096 (1980), and (Tb, La)-Fe-B alloys by N. C. Koon and B. N. Das in *Appl. Phys. Lett.* 39, 840 (1981). The main characteristics of these permanent magnets are high coercive force (intrinsic coercivity ($_iH_c$) of the order of 15 kOe), high remanence ($B_r$=10 kOe for the oriented materials), and high energy products ($(BH)_{max} \geqq 40$ MGO for the oriented materials).

U.S. Pat. No. 4,496,395 teaches a rare earth-iron permanent magnet consisting essentially of 20–70 atomic % Fe or Fe and Co, the balance being at least one rare earth element such as neodymium. E.P.O. Publ. 0,108,474 teaches an iron-rare earth-boron permanent magnet composition consisting essentially of, in atomic %, 10–50% of at least one rare earth metal with Nd and Pr preferred, 25–9% boron, and 45–85% iron or iron plus cobalt. Each of these references produces its magnets by a rapid solidification process known as "melt spinning" which produces the desired alloy in the form of thin (30–50 micron, max. 200 micron) ribbons (about 1–5 mm wide) which are cooled sufficiently fast so as to produce a very, very fine crystalline structure, but not so fast as to produce an amorphous, i.e. completely glassy, product which in the E.P.O. publication is taught: "cannot be later annealed to achieve magnetic properties comparable to an alloy directly quenched at the optimum rate." (pp 14–15) To form a bulk material from the ribbon, the ribbon is then pulverized into a powder with a roller on a hard surface and the pulverized powder then compacted and magnetized. The pulverizing and compacting steps are not taught as being performed under inert conditions and therefore substantial surface oxidation of the fine powder particles must inherently occur during the production of the bulk crystalline products thicker than 200 microns. No bulk amorphous products can be produced by the procedures disclosed, especially having very low oxygen contents.

E.P.O. Publ. 0,106,948 teaches a permanent magnet composition consisting essentially of, in atomic%, 8–30% of at least one rare earth element, 2–28% boron, not more than 50% cobalt, and the balance iron. The reference states: "It would be practically impossible to obtain practical permanent magnets from [prior art] ribbons or thin films. That is to say, no bulk permanent magnet bodies of any desired shape and size are directly obtainable from the conventional Fe-B-R base melt-quenched ribbons or R-Fe base sputtered thin films." (page 4, 1. 3–8, R=rare earth metal) Therefore, it teaches the preparation of bulk magnet compositions by the steps of (i) casting the desired composition in argon into alloys having a tetragonal system crystal structure, (ii) grinding the alloys to form crystalline grains having sizes of about 1.5 to 50 microns, (iii) orienting the grains in a magnetic field and compacting them in air under pressure, and (iv) sintering the resultant body at elevated temperature in an argon atmosphere. The grinding, which is not performed in an inert atmosphere, inherently produces oxide coatings on the particles formed, thereby substantially increasing the oxygen content of the final body. Since no steps are suggested for removing the oxide surface layer produced, oxygen clearly must be present in the final sintered body in an amount substantially above that produced herein. Moreover, the final body after sintering cannot possibly be amorphous because the sintering step must be performed at such an elevated temperature that any amorphous material would have to be converted to crystalline.

Lee, "Hot-Pressed Neodymiun-Iron-Boron Magnets", *Appl. Phy. Lett.* (4698) Apr. 15, 1985, pp 790–1, teaches an iron-neodymium-boron permanent magnet powder compact prepared from rapidly quenched alloy ribbons which are then reduced to powder and consolidated. When such powder compacts are bonded by plastics or other materials, it is possible to maintain the initial phase of the starting materials, but the final body has a reduced total metal content, i.e. a density of less than about 85%, and therefore lower magnetic and structural properties. When no binder is used, the subsequent high temperature processing during compacting precludes maintaining the amorphous phase which may have been initially present.

Other references to techniques for fabrication of Fe-Nd-B magnets which include going through a powder stage include melt-spinning, pulverization and consolidation, as taught by J. J. Croat in *Appl. Phys. Lett.* 37, 1096 (1980); N. C. Koon and B. N. Das in *Appl. Phys. Lett.* 39, 840 (1981); and J. J. Croat et al. in *J. Appl. Phys.* 55, 2078 (1984); inert atmosphere powder metallurgy using equilibrium processed alloy as discussed by M. Sagawa et al. in *J. Appl. Phys.* 55, 2083 (1984); reduction diffusion of Nd-oxide, using the method of Ko-Cheng of the Iron & Steel Research Institute, Peking, China; and activated sintering of constituent elements, as taught by H. H. Stadelmaier et al. in J. Appl. Phys. 56, (1985).

The sequence of rapid solidification processing (RSP) techniques, e.g. melt spinning, twin roller forming, and the like, to form amorphous products which are then pulverized or comminuted into a powder, has led to the discovery that good performance can be achieved with rare-earth/transition metal alloys, for example $Fe_{77}Nd_{15}B_8$ and $Fe_{81}Nd_{14}B_5$. The raw material costs of such alloys are approximately one third that of Sm-Co alloys and the ingredients are not of a critical nature or an unstable source. Independent research efforts at General Motors Research Laboratories, General Electric Research & Development Center, Naval Research Laboratories, University of Kansas, and Sumitomo Special Metals have converged on the $Fe_{77}Nd_{15}B_8$ alloy which has been prepared by the techniques described above. The principal drawback in performance of this alloy seems to be the temperature dependence of remanent induction.

The processing of Fe-Nd-B permanent magnets by techniques which require forming a powder, as discussed above, leaves a great deal to be desired. In particular, the presence of the highly reactive Nd makes prevention of oxidation of the powdery particulate material, which must then be compacted to produce bulk bodies of any substantial size, nearly impossible. Since the presence of oxygen is known to degrade the magnetic performance of magnets as well as their mechanical properties, there is a need for a method of producing bulk magnets in such a manner that the final oxygen content therein is as small as possible, preferably less than about 1,000 ppm.

It is therefore an object of the invention to produce a permanent bulk magnet by using a technique wherein processing parameters are readily controlled such that the microstructure of the material produced can range from crystalline to amorphous and the material generated is in a bulk form so that it does not require subsequent conversion into a powder to generate its desired final shape, i.e. it is directly deposited from a molten alloy of the desired composition. The procedure produces desired permanent bulk magnets while avoiding any significant oxidation of the sensitive constituents.

It is a further object of this invention to provide a permanent bulk magnet comprising readily available, relatively stable and inexpensive constituents.

It is a still further object of the present invention to provide bulk, permanent, isotropic magnets with high intrinsic coercivity, high remanance, and high strength.

It is a still further object of the present invention to produce at least about 90% dense amorphous bulk materials, especially such materials having a thickness of at least 250 microns and, preferably, an oxygen content of less than about 1,000 parts per million.

SUMMARY OF THE INVENTION

Bulk permanent magnets are made by liquid dynamic compaction (LDC) of appropriate alloys onto a high quench capacity substrate of a conductive material within an inert gas atmosphere. Isotropic permanent magnets with high intrinsic coercivity and remanance can be formed by annealing the LDC deposited alloy, the initial microstructure of which may vary from amorphous to crystalline. The bulk magnets are produced without converting the deposit to a powder and have substantially reduced oxygen contents as compared to similar magnets produced by prior art powder metallurgical techniques.

Bulk amorphous materials are made having as-deposited densities greater than at least about 90% of theoretical by liquid dynamic compaction. The bulk amorphous materials do not require any subsequent sintering or bonding, which could cause the loss of the desirable amorphous structure, to be useful for certain structural or mechanical functions. Also the materials contain extremely low levels of oxygen, preferably less than 1000 ppm.

DETAILED DESCRIPTION OF THE INVENTION

Figure 1:
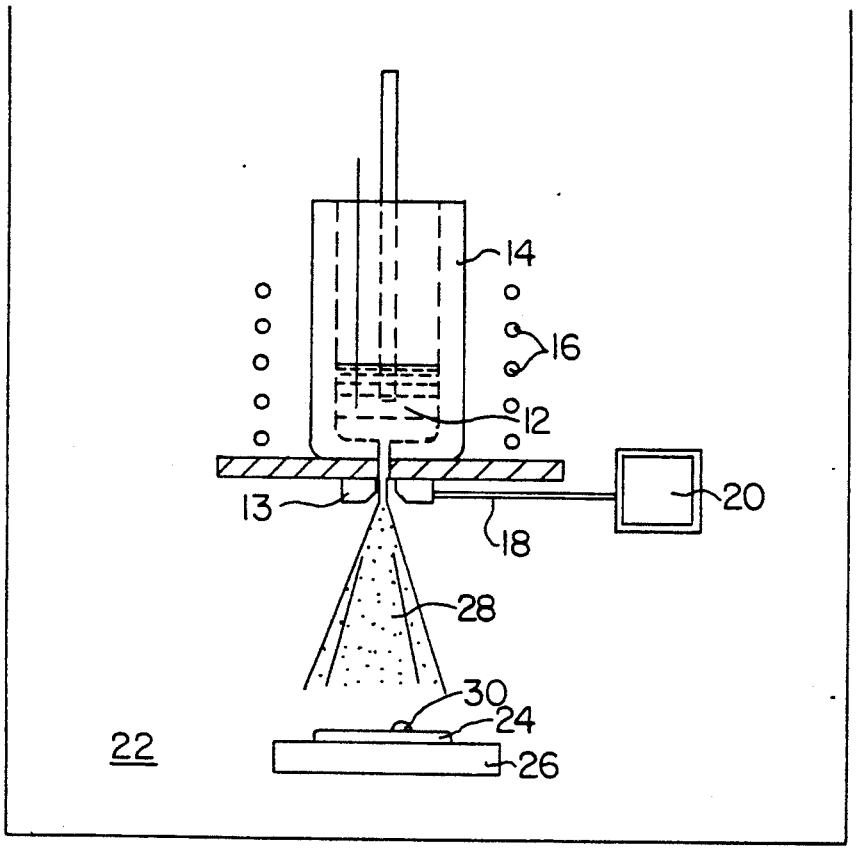
FIG. 1 is a schematic view of the LDC process.

Liquid dynamic compaction (LDC) is a new process for direct fabrication of solid, even massive, bodies directly from a molten spray of fine, atomized, liquid or semi-liquid droplets. The process combines the advantages of rapid solidification (control of microstructure, segregation, and physical properties) with simultaneous consolidation to a final shape directly from the rapidly-quenched droplets, without exposure to any atmosphere except that chosen for use in the atomization process itself, typically an inert gas such as helium or argon. This process has been demonstrated by E. J. Lavernia in "Liquid Dynamic Compaction of a Rapidly Solidified 7075 Aluminum Alloy Modified with 1% Ni and 0.8%

Zr", M. S. Thesis (1984), MIT, Cambridge, Mass., submitted for publication, to yield low oxygen content, high density, high-strength, complex RS aluminum alloys in massive quantities suitable for machining and finishing or for rolling, extrusion, or upsetting or hot isostatic pressing (HIP).

LDC builds on the process of gas atomization. In gas atomization, a stream of molten alloy is broken (shattered) into a spray of fine droplets by jets of a high velocity, generally inert gas. The droplets solidify rapidly due to their large surface areas and high velocity relative to the atomizing gas and are collected, generally in a cyclone collector at the bottom of the atomizing chamber, as particles ranging in size from a few microns up to a few hundred microns. In LDC to produce substantially, i.e. at least about 80%, amorphous deposits, the atomization and cooling conditions need to be such that essentially all of the droplets are completely liquid, and have not started to crystallize, when they contact a metallic substrate surface which has been placed beneath the atomization cone. Also the droplets are sufficiently undercooled prior to contacting the substrate surface that the temperature of the splats formed is below the liquidus temperature of the alloy. And the deposit, including its top surface, is maintained below the crystallization temperature of the alloy. To produce deposits which contain a substantial amount of crystallinity, the atomization and cooling conditions of the LDC process are modified such that most of the droplets, although they may be liquid, are about to or have begun to solidify when they contact the substrate and, although they may be undercooled, are either not sufficiently undercooled to produce a substantially amorphous deposit or the temperature of the deposit, especially its top surface, is not maintained sufficiently low as to produce an amorphous deposit. In both variations, LDC eliminates the handling of powders, their canning, compaction, and sintering or hot isostatic pressing to form the bulk materials. The problem of oxygen contamination of powders is substantially avoided with LDC by (i) the use of an inert gas, e.g. argon or helium, in the chamber and for the atomization, (ii) the rapid delivery of subsequent droplets to protect previously deposited droplets from oxidation, and (iii) the protective shielding of the main portion of the deposit by those droplets which are in the outer shell of the spray cone, i.e. the gettering effect at the periphery of the atomization cone.

Application of the LDC process to the highly reactive alloys used herein was possibly dismissed by others as being too dangerous and/or too difficult to control. Production of fine powders of Al and many rare earth-containing alloys has sometimes led to explosions. This is avoided in the present invention due to the inert atmosphere and the protective gettering effect at the periphery of the atomization cone.

The LDC process used in the present invention is shown in FIG. 1. Premelted chunks of alloy 12 are induction melted in a crucible 14 surrounded by a RF induction coil 16 under an inert gas, e.g. argon, atmosphere. Alternatively, the alloy may be melted in a vacuum and the melting chamber then filled with an inert gas prior to atomization. The molten alloy 12 is atomized through a gas atomization nozzle 13 by ultrasonic inert gas jets 18 backed by a dynamic tank 20 pressure of about 100 to 1,000 psi, preferably about 200 to 600 psi. During the LDC process, the pressure in the chamber 22 generally is slightly positive, e.g. 16 psi. Rapidly solidified alloy 24 builds up on a metallic substrate 26 at controllable rates which can easily exceed 1 cm/min. Rapid solidification is accomplished by rapid cooling of the high-velocity atomized droplets 28 to a temperature below their melting point (undercooling) in combination with good thermal contact with the substrate 26, which is preferably made of a good conductor, i.e. a metal such as copper, ferritic stainless steel, molybdenum, simple low alloy steels, or the like. The high degree of undercooling that occurs results from a low density of (for the at least partially crystalline deposits) or substantial absence of (for substantially amorphous deposits) sites for heterogeneous nucleation in each of the fine droplets. The droplets, after impacting upon the substrate and forming "splats", continue to cool to temperatures well below their liquidous temperature. When crystalline deposits are produced, the droplets generally solidify either by homogeneous nucleation or by heterogeneous nucleation on an impurity in the droplet, on the substrate, or on the LDC compact itself. When amorphous deposits are produced, the droplets harden during progressive rapid cooling as glassy (amorphous) materials in the substantial absence of nucleation.

In LDC, droplet 28 sizes generally range from about 1–200 microns. The droplets are collected on the substrate as splats 30. Adherence of the splats 30 to the substrate 26 is thought to depend on the angle at which the droplets 28 impinge on the substrate 26, the substrate surface finish (generally deliberately roughened), as well as on the distance between the nozzle 13 and the substrate 26. Droplets 28 impinging on the substrate at an angle $\theta$ (relative to the normal) which is less than about 13°–15 (for the conditions described in the examples herein) adhere to the substrate 26. For larger angles $\theta$, the droplets 28 may bounce off the substrate 26 and be found as particles at the bottom of the chamber.

The melt superheat and flow rate, the atomization gas pressure and thus flow rate, the distance between the substrate and the nozzle, as well as the quench capacity of the metallic substrate are all important in determining the microstructure, thickness, density, and adherence of the particles on the substrate. Due to the processing conditions and geometry, what little oxidation of the highly reactive Nd and Fe constituents occurs is confined largely to the outer surface of the atomization cone and thus the extreme edges of the deposited material. Such edges can be machined away if even lower oxygen content products are desired.

Amorphous bulk materials are produced when the LDC process is operated under conditions which result in (i) the droplets being fully liquid upon impact with the substrate surface, (ii) the droplets containing substantially no crystallites, (iii) the droplets being sufficiently undercooled in flight and further quenched by the substrate to substantially prevent formation of any crystalline nuclei on cooling thereof through the glass transition temperature, and (iv) the rate of cooling being sufficiently high that the splats have hardened into an amorphous state prior to impact of the next droplet. Also, the temperature of the top surface of the material being spray formed should be maintained at less than the crystallization temperature of the alloy being deposited so that devitrification of the deposited bulk material does not occur to any substantial extent.

The quench rates of the droplets must be sufficiently high to accomplish these conditions. Such necessary high quench rates have been found to be comparable to those of other substrate quenching techniques such as melt spinning, twin roller quenching, and the like, which techniques cannot directly produce bulk materials. In addition it has been found that when amorphous bulk materials are deposited, it is preferable to generate atomized droplets which are generally smaller than those used to produce substantially crystalline bulk products. The smaller size is helpful in achieving the required extent of undercooling (higher surface area per droplet) so that the droplets are fully molten upon impact and splatting. The smaller size also serves to reduce the likelihood of any single droplet containing a heterogeneous nucleation site.

Conditions which favor the formation of amorphous bulk materials include: high gas to metal mass flow ratio to decrease the droplet size; high degree of undercooling prior to splatting; low deposition rate, i.e. low metal mass flow rate; and high rate of heat extraction by the substrate. Specific conditions required to produce an amorphous bulk material will vary depending upon the specific alloy being deposited as well as the deposition equipment and conditions utilized. As such, routine experimentation must be performed to determine specific operating conditions for each new system. The operating conditions which are varied generally include one or more of: metal flow rate, gas pressure, substrate distance from the point of atomization, and substrate quench capacity, though other conditions such as substrate thickness and the like may also be varied. Broad ranges of operating conditions within which suitable specific conditions are likely to be found include: metal alloy mass flow rate of about 0.2 to 2 kg/min; gas pressure of about 100 to 1,000 psi; substrate distance of about 20 to 60 cm; substrate quench capacity greater than about 1000° K./sec. Variation in any single condition can effect the extent of crystallinity or substantial lack thereof in the resultant deposit and can often be compensated for by variation of one or more other conditions. For example, when all other conditions are held constant and the substrate distance is reduced, the amorphous content of the resultant deposit generally increases until the substrate distance reaches a critical minimum for the other conditions. Also, when the gas pressure is increased, the droplet size is decreased and the quench rate increases, resulting in a greater production of the amorphous structure.

The quench rate for producing bulk amorphous FeNdB deposits, based on simple splat quenching assumptions which apply to most substrate quenching processes such as splat quenching and melt spinning, has been calculated to be on the order of about 1,000° to 10,000° K./sec.

Bulk materials having a substantial crystalline content are produced when the LDC process is operated under conditions wherein most of the droplets have begun to or are just about to solidify at the moment they impact upon the substrate surface. Substantially crystalline materials can also be produced when the droplets are completely liquid if a substantial number of them contain heterogeneous nucleation sites or such sites form by the mechanical shock of splatting or the deposit is not sufficiently quenched by the substrate to continually maintain the temperature below the liquidus temperature of the alloy. Also materials having substantial crystallinity are produced when the temperature of the top surface of the material being deposited is not maintained below the liquidus temperature of the alloy.

When deposits having substantial crystallinity are to be produced, a lower quench rate for the droplets is generally used, i.e. somewhat lower than that used for other substrate quenching techniques such as melt spinning, twin roller quenching, and the like.

The present invention is applicable to the production of bulk amorphous and crystalline materials of the most useful compositions for magnetic applications, e.g. FeNdB, FeBSi, CoBSi, FeNiBSi, CoFeBSi, and the like, as well as to amorphous materials of the most useful compositions for structural or mechanical applications, e.g. FeCrBSi, FeBSi, FeNiCrB, FeNiCrBSi, and the like. The atomic percents of the elements in specific alloys may vary widely. The only limitation on an alloy for use in preparing bulk permanent magnets is that the alloy be capable of exhibiting magnetic properties. The only limitation on an alloy for preparing bulk amorphous materials is that it be capable of remaining in the amorphous state upon undergoing rapid quenching.

Preferred alloys useful for producing bulk permanent magnets are those of the general formula:

$$(Fe_{1-x}T_x)_a(Nd_{1-y}R_y)_b(B_{1-z}M_z)_c$$

wherein

T is selected from Co, Ni, Cu, Mn, Cr, V, Ti, and combinations thereof;

R is selected from Pr, Pm, Sm, Tb, Dy, Ho, Er, Tm, and combinations thereof;

M is selected from Si, C, P, and combinations thereof;

x is from 0 to 1; y is from 0 to 1; and z is from 0 to 1;

a+b+c=100 atom % and "a" is from about 60 to about 95 atom %; "b" is from about 0 to about 30 atom %; and "c" is from 0 to about 25 atom %.

Preferably, x is from 0 to about 0.75 and y is from 0 to about 0.75. "a" is from about 70 to about 90 atom %; "b" is from about 5 to about 20 atom %; and "c" is from 0 to about 15 atom %. More preferably, x is from 0 to about 0.5; y is from 0 to about 0.5; "a" is from about 70 to about 90 atom %; "b" is from about 5 to about 20 atom %; and "c" is from 0 to about 15 atom %.

Specific non-limiting examples of suitable such alloys include:

$Fe_{57}Co_{20}Nd_{15}B_8$
$Fe_{59}Co_{20}Nd_{15}B_6$
$Fe_{77}Nd_{15}B_8$
$Fe_{81}Nd_{14}B_5$
$Fe_{79}Nd_{15}B_6$
$Fe_{77}Pr_{15}B_8$
$Fe_{81}Pr_{14}B_5$
$Fe_{59}Co_{10}Nb_{10}Nd_{15}B_6$
$Fe_{57}Co_{10}A_{12}Nd_{15}B_6$.

Alloys useful to produce the bulk amorphous materials of this invention may also be selected from those of the above formula, provided that they are capable of forming amorphous products. Preferred such alloys for soft amorphous magnets include:

$Fe_{80}B_{16}Si_4$
$Fe_{40}Ni_{40}(BSi)_{20}$
$Fe_{39}Ni_{38}Mo_3(BSi)_{20}$
$Co_{70}Fe_5Si_{15}B_{10}$
$Fe_{80-q}Z_q(BSi)_{20}$ wherein q is from 0 to about 10 and Z is selected from the group consisting of Mo, Cr, and Nb; and $Fe_{80-r}Y_r(BSi)_{20}$ wherein r is from 0 to about 0.75 and Y is selected from the group consisting of Co and Ni.

Compositions capable of forming amorphous deposits herein include those which form glasses by melt spinning, especially when such compositions produce amorphous ribbons over a broad range of compositions. Generally, on a phase diagram of the alloy elements, such compositions are those within a deep eutectic trough. Currently, however, the more complex alloys involving 4, 5, or more elements cannot be classified as to predictability of glass formation. To determine if a specific composition is capable of forming an amorphous deposit, trial deposits with a specific composition must be made. The deposition conditions should be selected, and varied if necessary, in accordance with the broad principles of producing amorphous deposits described above.

The bulk materials are produced as spray deposited materials with densities greater than about 90%, preferably greater than 93%, and most preferably about 93–99%, which means that no substantial additional densification procedure is required during which the desired amorphous properties could be lost. The bulk materials produced herein have a thickness greater than about 250 microns, preferably greater than 1 mm, more preferably greater than about 3 mm, and most preferably greater than about 5 mm. The main limitation on the maximum thickness of the bulk materials produced herein is the heat removal capacity of the substrate, e.g. liquid-cooled (water, nitrogen, or the like) substrates can produce thicker deposits than non-liquid-cooled substrates. The maximum volume of the bulk materials for a given thickness is limited only by the physical size of the equipment used to perform the spray deposition. The bulk materials produced contain little oxygen beyond the amount contained in the initial alloy which is processed in accordance herewith. Generally, the total oxygen content of the bulk as-deposited materials will be less than 1,500 ppm and usually it will range from about 200 to about 1000 ppm. Preferably the oxygen content will be less than about 800 ppm, most preferably less than about 500 ppm. While good magnetic properties have been observed in bulk amorphous materials having oxygen contents up to 3,000 ppm, such materials have been extremely brittle and of limited commercial interest. A substantial amount of the oxygen content above that of the starting alloy is concentrated in the edges of the deposit which can be machined off, if desired. Although bulk amorphous deposits containing less than 2% crystallinity have been produced by the procedures disclosed, deposits are considered to be substantially amorphous herein if they contain less than about 20% crystallinity, preferably less than about 10%, and more preferably less than about 5%, and most preferably less than about 3%. The compositions used herein to produce bulk amorphous materials are those in which the stable state is crystalline.

Bulk amorphous materials such as FeCrBSi and FeBSi may be directly used as soft magnetic cores, shields, inductors, tape heads, and the like. If desired, the bulk amorphous materials may be heat treated to develop certain microstructures, such as microcrystalline or nanocrystalline structures, which make the bulk material useful in a variety of mechanical and hard or soft magnetic applications, depending upon the specific alloy composition and the processing used. For example, heat treatment of FeNdB amorphous alloys above their crystallization temperatures (Tx=about 600° C.) has resulted in the controlled formation of microcrystalline structures that show excellent hard magnetic properties. The at least partially crystalline bulk materials as-deposited are especially useful for forming bulk permanent magnets, generally by subsequent heat treatment.

In the following non-limiting examples of the present invention, all parts and percents are by weight unless otherwise specified.

EXAMPLE I

To demonstrate the preparation of bulk permanent magnets from crystalline bulk deposits in accordance with one aspect of the invention, $Fe_{57}Co_{20}Nd_{15}B_8$ and $Fe_{79}Nd_{15}B_6$ were deposited onto copper substrates by the liquid dynamic compaction process and the depositions were then annealed at temperatures between 300° and 900° C. Coercivity was measured as a function of annealing temperature. Maximum coercivity of the LDC deposited $Fe_{57}Co_{20}Nd_{15}B_8$ resulted after annealing for one hour at 450° C.

For the example, chunks of alloys with nominal compositions $Fe_{57}Co_{20}Nd_{15}B_8$ and $Fe_{79}Nd_{15}B_6$, provided by Colt Industries Crucible Research Center, were induction melted in an argon atmosphere and then deposited using the equipment of FIG. 1 in which gas spray nozzle diameters of 5 mm were used. The gas atomization pressure was 200 psi and the deposits were onto copper substrates.

Properties and adherence of atomized splats onto a multi-level substrate having four roughened platforms at different spray distances from the gas atomization nozzle were determined. The copper substrates were placed at 10, 12, 14, and 16 inches from the atomization nozzle. The densities of the deposited materials were determined by Archimedes' method. Magnetic properties were measured at the M.I.T. National Magnet Lab using a SQUID magnetometer in fields up to 50 kOe.

Heat treatments were done in an argon atmosphere to modify the magnetic properties of the deposited material. The annealing cycles consisted of rapidly heating the material up to soaking temperatures, $T_1$, of from 300–900° C., and held for one hour. Cooling was typically done in an oven at about 1° C./min. Optical microscopy (OM) and scanning electron microscopy (SEM) were utilized to investigate the microstructures of the alloys after metallographic polishing and etching in 1% Nital (1% nitric acid in ethanol).

X-ray diffraction studies were made on ground powders of the deposited alloy and on heat-treated materials using a conventional diffractometer.

The LDC-deposited crystalline $Fe_{57}Co_{20}Nd_{15}B_8$ had a thickness of approximately 10 mm in the center which decreased to approximately 1 mm at the periphery. Total weight was about 450 g. The analyzed Nd, B, and $O_2$ contents were 30.4, 1.69, and 0.049 wt % respectively, compared with starting values of 32.7, 1.3, and 0.03 wt %, respectively.

Figure 2:
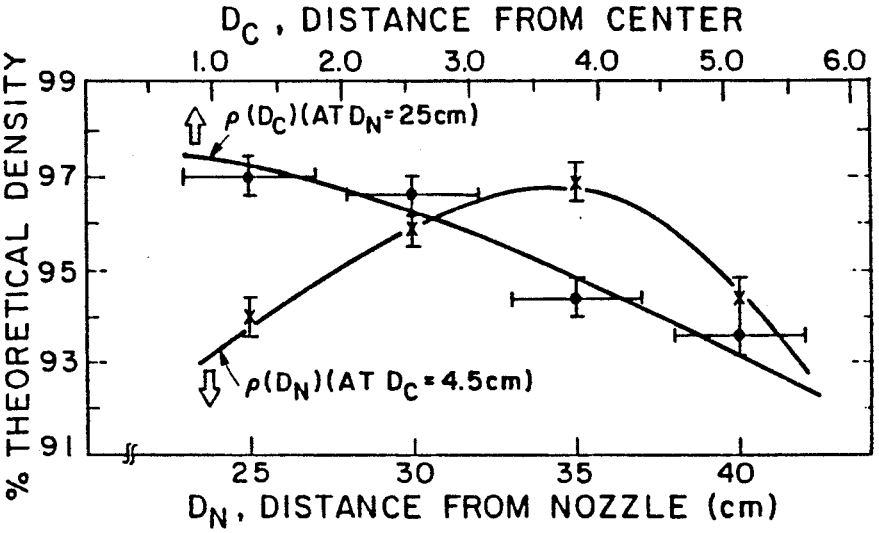
FIG. 2 is a graph of the ratio of the measured density to the theoretical density of LDC deposited $Fe_{59}Co_{20}Nd_{15}B_6$ on a copper substrate as a function of the distance between the substrate and gas atomization nozzle, $D_n$, and also as a function of the distance between the material being analyzed and the center of the deposit $D_c$.
Figure 3:
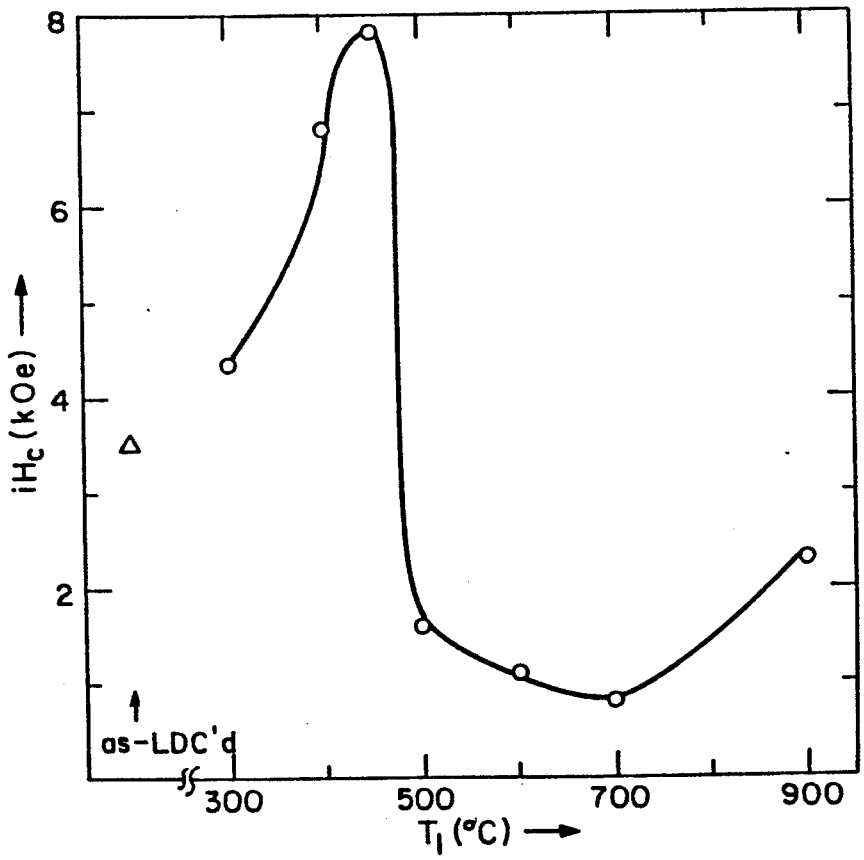
FIG. 3 is a graph of the intrinsic coercivity ($_iH_c$) of LDC deposited $Fe_{57}Co_{20}Nd_{15}B_8$ as a function of annealing temperature, $T_1$.

For the $Fe_{57}Co_{20}Nd_{15}B_8$ alloy, the measured, as-deposited densities varied from 93 to 97% of the theoretical value (calculated to be 7.79 g/cm$^3$ by assuming a $Nd_2(FeCo)_{14}$ single phase). The density measured on the starting alloy was 7.69 g/cm$^3$. The variation in the as-deposited density as a function of distance between the substrate and nozzle ($D_n$) and as a function of distance from the center of the deposit ($D_c$) is shown in FIG. 2. As $D_n$ increases, the density increases to a maximum and then decreases. This is due to a competition between turbulence which favors higher density at longer distances from the nozzle and the mean temperature of the spray which favors higher density at shorter distances. The optimum $D_n$ distance from the nozzle in this particular example is 35 cm. The as-deposited density decreases monotonically with increasing $D_c$ as a consequence of the mass distribution of the atomization stream.

The optical metallographic microstructure of the LDC deposited alloy is typical of crystalline rapidly solidified structures. The interdendritic spacings vary across the sample in the range of 0.9 to 10 microns, with the most probable spacing being between 3 and 4 microns. Such interdendritic spacing indicates that the material was subjected to a cooling rate on the order of 100° to 1000° C./sec. Optical microstructures of material taken from the $D_n=25$ cm substrate at $D_c=2.5$ cm show no obvious difference between microstructures taken parallel and perpendicular to the substrate surface, suggesting that most of the atomized droplets were delivered as supercooled liquids upon impact. There are some entrapped, small spherical particles which probably solidified before impact. The number of entrapped particles increases slightly as $D_n$ increases. Also visible in the micrographs are porosities and inclusions which may serve as nucleation sites for crystallization.

Figure 4:
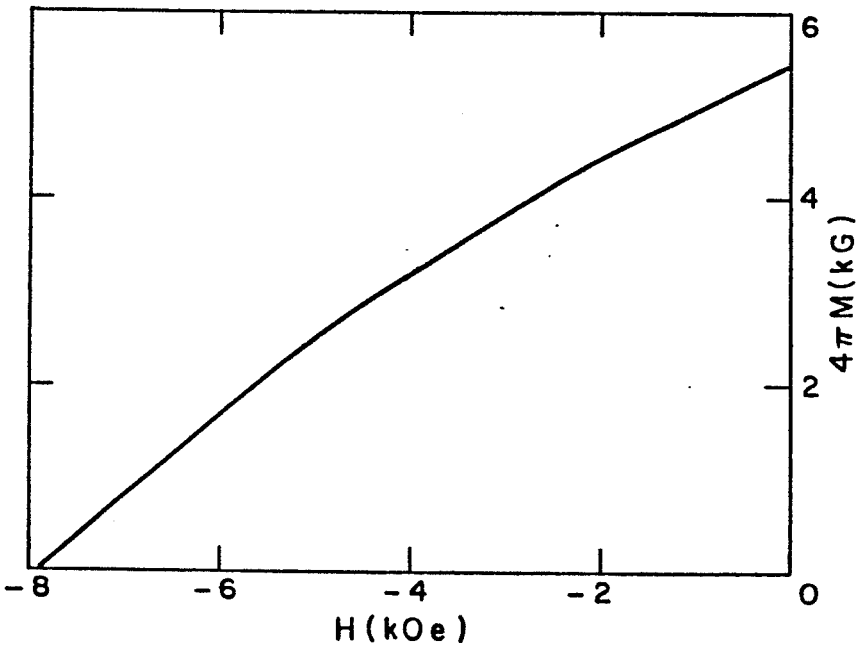
FIG. 4 is a graph of the demagnetization curve for LDC deposited $Fe_{57}Co_{20}Nd_{15}B_8$ annealed at 450° C.

The intrinsic coercivity ($_iH_c$) of the LDC as-deposited $Fe_{57}Co_{20}Nd_{15}B_8$, is 3.5 kOe. This is a high value as compared to the typical 1 kOe values reported for conventionally cast bulk crystalline materials or consolidated powders, prior to undergoing heat treatment. Remanance before heat treatment is 4600 G. Heat treatments at different $T_1$ temperatures have a dramatic effect on the $_iH_c$ value, increasing it to 7.8 kOe for the $Fe_{57}Co_{20}Nd_{15}B_8$ composition. A typical demagnetization curve for the 450° C. heat-treated bulk deposit is shown in FIG. 4.

From the microstructures, it is clear that heat treatments of LDC deposited $Fe_{57}Co_{20}Nd_{15}B_8$ above 700° C. induce recrystallization and grain growth. For $T_1$ less than 600° C., the microstructure remains practically unchanged. The deterioration in $_iH_c$ for deposits heated at $T_1$ greater than 700° C. is probably due to the loss of fine structures. A small-scale reaction such as redistribution of boron and/or the stabilization of the tetragonal phase, while retaining the fine structure, is probably the main reason for the increasing coercivity.

The optimum annealing conditions for the various crystalline LDC as-deposited alloys have not been determined. Procedures for annealing and determining which conditions maximize the desired properties of certain powder metallurgy compacts are well known to those skilled in the art. It may be that optimizing the hard magnetic properties of LDC compacts requires different annealing techniques than apply in other permanent magnets.

X-Ray diffraction patterns of the LDC material both as-deposited and after heat-treatment fit well with the calculated d values using lattice parameters of $Nd_2Fe_{14}B$ and $Nd_2Fe_7B_6$ phases published by M. Sagawa et al. in *IEEE Trans. Mag.*, MAG 20, 1584 (1984). The $Nd_2Fe_7B_6$ phase (Nd and B-enriched) is also obviously present. A SEM micrograph from an alloy deposit heat treated at 600° C. shows that the Nd-rich phase is concentrated at the grain boundaries. The diffraction patterns contain a few minor, unidentified peaks, suggesting the presence of additional phases. These minor phases may be the result of microsegregation during solidification. Such fine precipitates may contribute to the high $_iH_c$ since high temperature solution treatments cause $_iH_c$ to decrease without significantly affecting $B_r$.

LDC processing of other Fe-Co-Nd-B alloys with finer starting microstructures than the LDC deposited $Fe_{57}Co_{20}$-$Nd_{15}B_8$ in the example have a coercivity peak at higher $T_1$ temperatures and/or longer times than for the FeCoNdB alloy. This allows better control over the heat treating process and more careful tuning of coercivity to peak values. Values obtained are comparable to those considered acceptable for many high-performance isotropic permanent magnet applications.

EXAMPLE II

A bulk amorphous material of the invention was directly deposited by the following procedure:

A master alloy having a nominal composition of $Nd_{15}$-$Fe_{77}B_8$ was induction melted in a chamber that had been evacuated and backfilled with argon. The alloy was atomized at 1450° C. with an ultrasonic gas atomizer (USGA) using argon at gas pressures of 10.5 and 17.5 kg/cm$^2$ (150 and 250 psi) using the equipment of FIG. 1 in which the spray nozzle diameter was 3 mm. The metal mass flow rate was about 25–50 g/sec. Sectional, multilevel copper substrates consisting of four collection plates at different elevations, i.e. 23, 27, 31, and 34 cm from the atomization nozzle, were placed under the atomization nozzle. Two different substrate thicknesses, 10 and 1 mm, were used to vary the solid state cooling rates. No cooling liquid was supplied to the substrates because of the relatively thin bulk sprayed deposits that were to be produced in comparison to the substrate thicknesses. The resultant LDC deposits were obtained as bulk materials having thicknesses ranging from about 1 to 6 mm and lengths ranging from about 30 to 100 mm. The densities of the samples ranged from 93 to 98 % of theoretical. The oxygen contents were each less than 800 ppm. Specimens were cut from the deposits for further processing and property measurements.

Figure 5A:
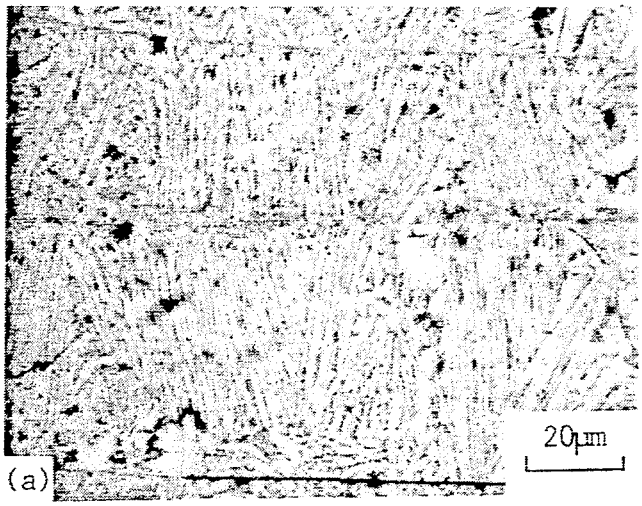
FIG. 5*a* is a photomicrograph of the as-deposited material of Example II produced at a gas pressure of 10.5 kg/cm$^2$ (150 psi) on a 10 mm thick substrate.
Figure 5B:
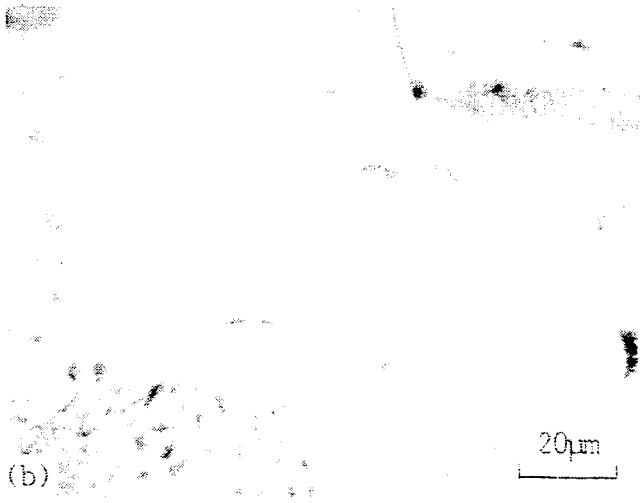
FIG. 5*b* is a photomicrograph of the as-deposited material of Example II produced at a gas pressure of 17.5 kg/cm$^2$ (250 psi) on a 10 mm thick substrate.

The bulk materials produced at a gas pressure of 17.5 kg/cm$^2$ were confirmed to be amorphous materials by using X-ray diffraction, differential thermal analysis, transmission electron microscopy, and microhardness investigations. The materials produced at a gas pressure of 10.5 kg/cm$^2$ were microcrystalline and contained substantial amounts of $Nd_2Fe_{14}B$. The microstructures of the materials produced at each of the gas pressures on 10 mm thick substrates are shown in FIGS. 5(*a*) and 5 (*b*).

Figure 6:
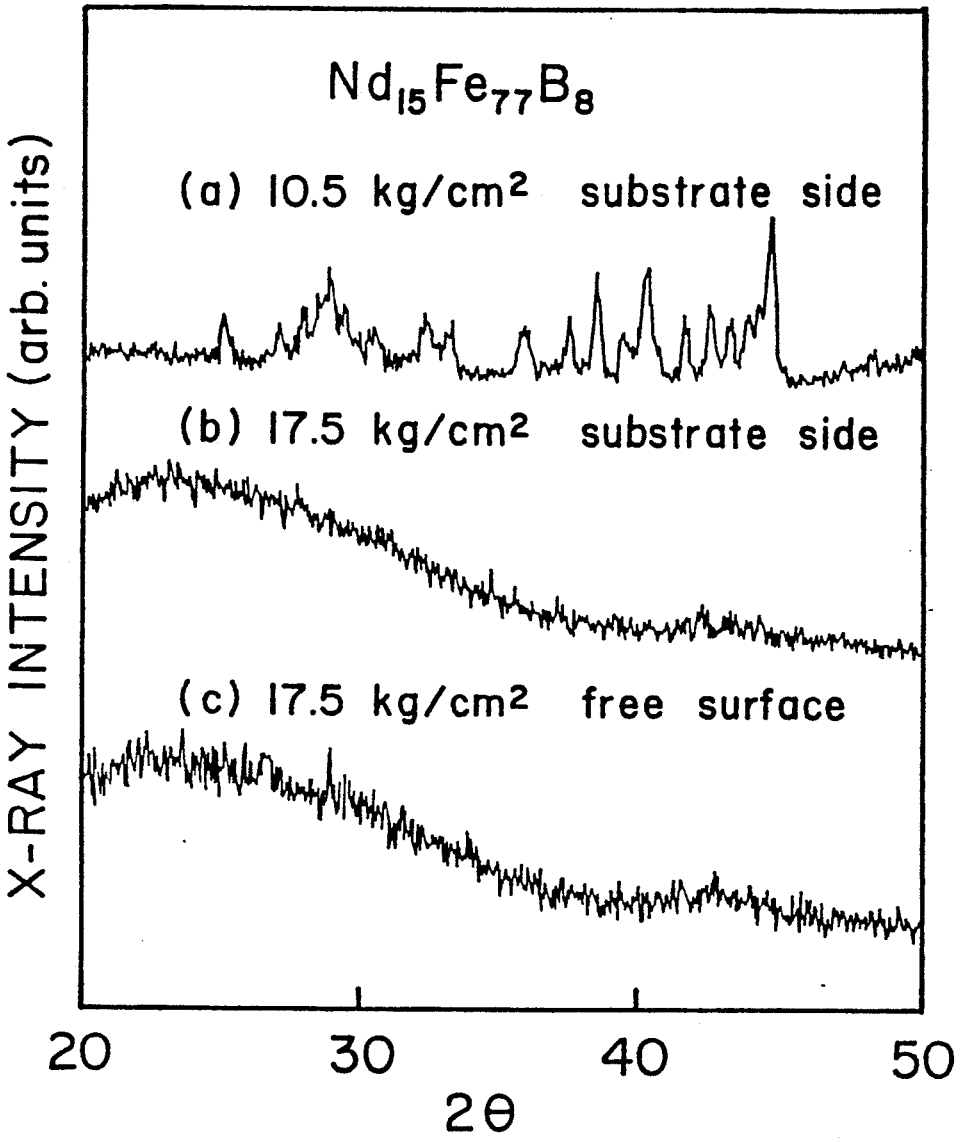
FIG. 6 is the X-ray diffraction patterns of the as-deposited materials of Example II.

FIG. 6 shows X-ray diffraction (XRD) patterns of the LDC deposits taken on both the substrate surface and on the upper free surface for the 17.5 kg/cm$^2$ gas pressure samples and on the substrate side for the 10.5 kg/cm$^2$ gas pressure samples. As can be seen, no indication of $Nd_2Fe_{14}B$ peaks is found for either the substrate surface of the higher gas pressure sample or the upper surface of the deposit, where cooling rates would be expected to be slightly less. Virtually no indication of crystallinity was found. The lower gas pressure sample exhibits well-defined $Nd_2Fe_{14}B$ peaks which indicates that the high gas pressure deposits are essentially fully in the amorphous state while the low pressure deposits contain substantial crystallinity.

Figure 7:
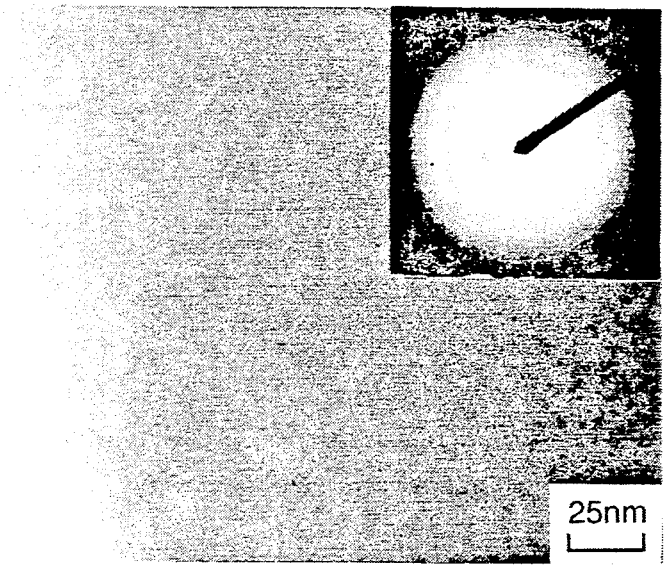
FIG. 7 is the differential thermal analysis curve of the as-deposited amorphous material of Example II.

FIG. 7 shows the differential thermal analysis (DTA) curve of the high gas pressure deposits. The DTA curve shows an exothermic peak at around 600° C., the crystallization temperature of the NdFeB amorphous structure. Thus the deposits produced at 17.5 kg/cm$^2$ had an amorphous structure.

Figure 8:
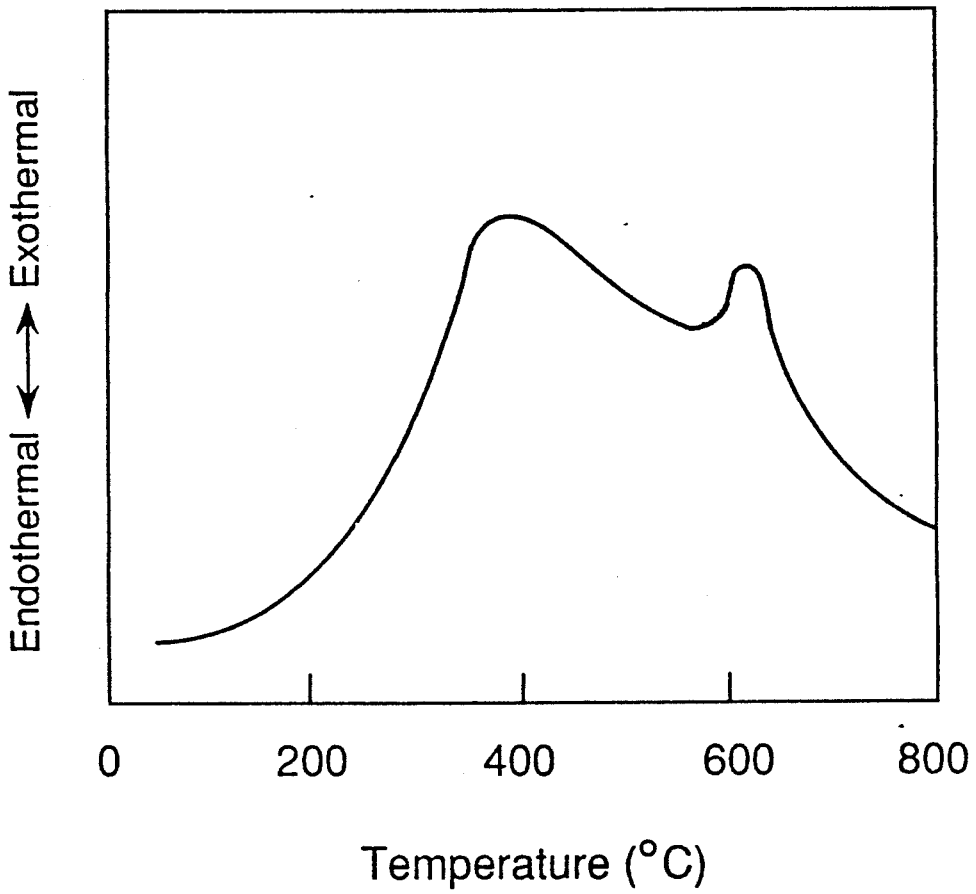
FIG. 8 is the transmission electron microscope micrograph of the material of FIG. 7.

FIG. 8 shows a transmission electron microscope (TEM) micrograph and a corresponding selected area diffraction (SAD) pattern. The TEM micrograph is featureless as expected for an amorphous material. The corresponding SAD pattern shows a broad "halo" pattern which is also characteristic of amorphous materials.

The microhardness value, Hv, of the high gas pressure deposits was determined to be 8.8 GPa, the same as that of amorphous melt-spun ribbons. This again confirms that the deposits are amorphous as are those of the amorphous melt-spun ribbons.

EXAMPLE III

The intrinsic coercivity of the amorphous LDC deposits of Example II was about 1 kOe or less while that of the crystalline deposits was about 5 kOe. To modify the magnetic properties of the amorphous samples, they were heat treated at elevated temperature by vacuum encapsulating the samples at a pressure of $1\times10^{-6}$ Torr in quartz tubes and then subjected to annealing for 1 hour. After heat treatment, the capsules were water quenched from the annealing temperature and the magnetic properties were measured by a vibrating sample magnetometer (VSM) using an electromagnet with a maximum applied field of 18 kOe. The samples were premagnetized in an applied magnetic field of 150 kOe at the National Magnet Laboratory at M.I.T.

Figure 9:
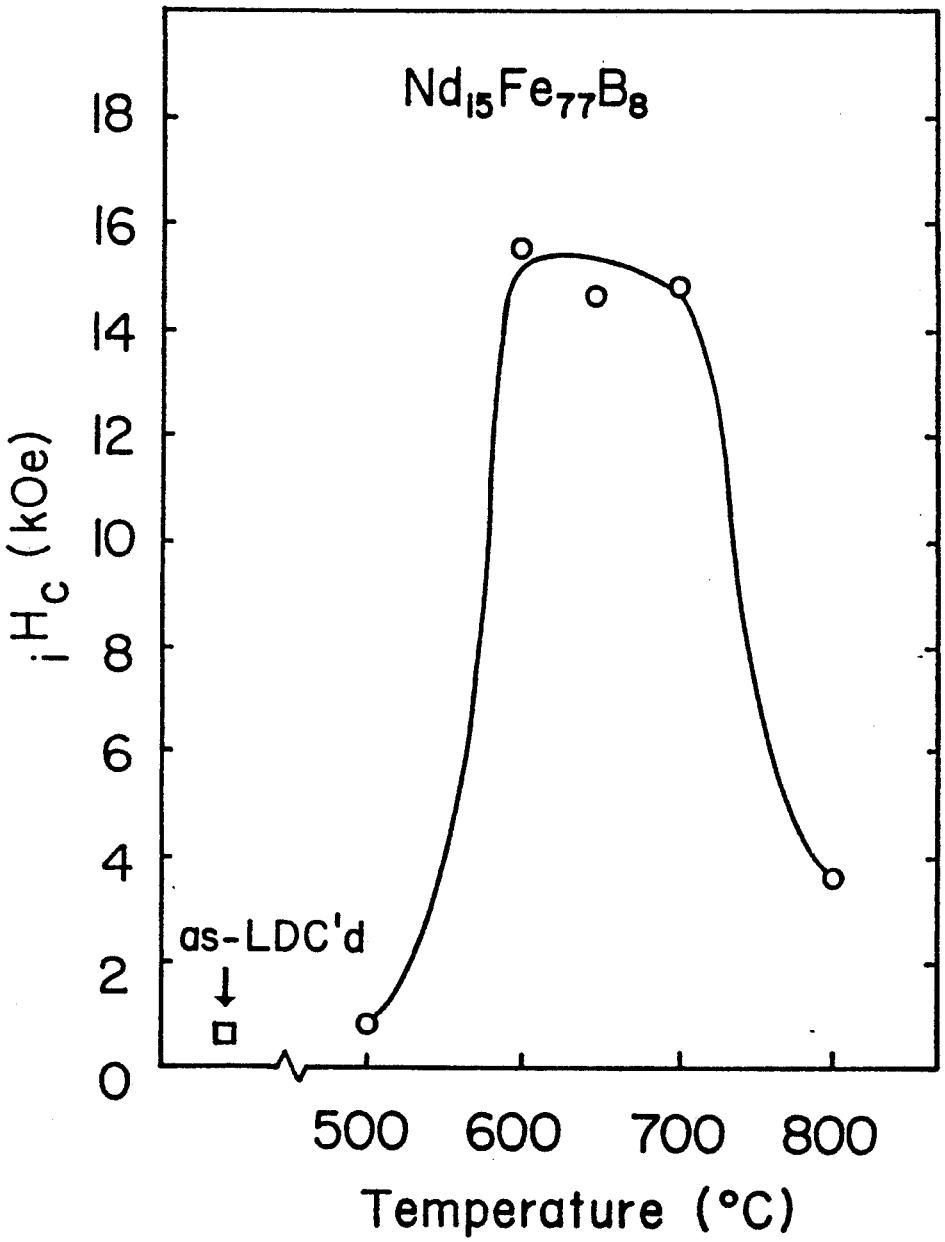
FIG. 9 is a plot of the intrinsic coercivity of the material of FIG. 7 as a function of annealing temperature.

The results shown in FIG. 9 demonstrate a rapid increase in $_iH_c$ at 600° C. which is believed to be caused by the formation of the magnetic $Nd_2Fe_{14}B$ phase. The coercivity reaches a plateau of about 15.6 kOe between about 600° and 700° C. and then rapidly decreases above 700 C.

EXAMPLE IV

The basic procedure of Example II is repeated to produce thicker and larger LDC deposits of $Nd_{15}Fe_{77}B_8$. In view of the increased size, water cooling of the substrate is used. The deposits are about $200\times300\times3$–6 mm thick. Analysis of the deposits confirms their amorphous state.

EXAMPLE V

The basic procedure of Example II is repeated except that the starting alloy is replaced by (i) $Fe_{81}Nd_{14}B_5$, (ii) $Fe_{80}B_{16}Si_4$, (iii) $Fe_{76}Cr_6B_{14}Si_4$, (iv) $Fe_{40}Ni_{40}B_{16}Si_4$, and $Co_{72}Mn_4B_{12}Si_{12}$. Deposits are produced using a 2.0 mm nozzle, at constant metal mass flow rate of about 20 g/sec, and at varying gas pressures ranging from about 10 to 70 kg/cm$^2$. As the gas pressure increases, the amount of amorphous material in the deposit also increases. Once the gas pressure is sufficiently high, the deposits are formed as bulk amorphous materials of greater than 90% density. The bulk amorphous materials so produced are suitable for use as motor laminations, inductive elements such as chokes and cores, and even tape heads.

Although this invention has been described with reference to specific embodiments, it is understood that modifications and variations of the compositions and methods of processing may occur to those skilled in the art. It is intended that all such modifications and variations be included within the scope of the appended claims.

What is claimed is:

1. A method for producing a bulk permanent magnet having a thickness of at least 250 microns and a density of at least about 90%, which comprises the steps of:

(i) melting in a container an alloy capable of exhibiting magnetic properties of the formula:

$$(Fe_{1-x}T_x)_a(Nd_{1-y}R_y)_b(B_{1-z}M_z)_c$$

wherein T is selected from Co, Ni, Cu, Mn, Cr, V, Ti, and any combination thereof;

wherein R is selected from Pr, Pm, Sm, Tb, Dy, Ho, Er, Tm, and any combination thereof;

wherein M is selected from Si, C, P, and any combination thereof;

wherein x is from 0 to 1; y is from 0 to 1; and z is from 0 to 1; and wherein $a+b+c=100$ atom % and "a" is from about 60 to about 95 atom %; "b" is from about 0 to about 30 atom %; and "c" is from 0 to about 25 atom %;

(ii) atomizing the molten alloy to form droplets by directing pressurized jets of an inert gas onto the molten alloy after it passes through a delivery means exiting the container;

(iii) depositing the alloy droplets onto a metallic substrate positioned at a distance away from the container opening wherein (a) a majority of the alloy droplets are in a liquid or semi-liquid state when they are deposited onto the substrate, (b) the droplets are rapidly quenched upon contact with the substrate or prior rapidly quenched droplets thereon and (c) the deposition continues until the deposit is at least about 250 microns thick; and (iv) removing the deposit from the substrate and, without forming a powder of the deposit, annealing the deposit at a sufficiently elevated temperature and for a sufficient period of time to produce a bulk permanent magnet.

2. The method of claim 1, wherein the alloy is selected from the group consisting of FeNdB, FeBSi, FeNiBSi, CoBSi, CoFeBSi, FeCrBSi, and FeNiCrBSi alloys.

3. The method of claim 1, wherein the alloy is melted in an inert gas atmosphere.

4. The method of claim 1, wherein the atomizing inert gas is supplied to the pressurized jets at a pressure of about 100 to 1000 psi.

5. The method of claim 1, wherein the deposited alloy contains less than about 1,000 parts per million oxygen.

6. The method of claim 1, wherein the substrate is liquid cooled.

7. The method of claim 1, wherein the deposited alloy has greater than 20% crystallinity.

8. The method of claim 7, wherein the droplets are just about to or have begun to solidify at the moment they impact the substrate.

9. The method of claim 7, wherein the temperature of the top surface of the substrate and the deposit produced thereon is at least about or greater than the crystallization temperature of the alloy being deposited.

10. The method of claim 1, wherein the deposited alloy is substantially amorphous.

11. The method of claim 10, wherein substantially all of the droplets are fully liquid upon impact with the substrate.

12. The method of claim 10, wherein the droplets remain substantially free of crystallites upon impact with the substrate.

13. The method of claim 10, wherein at the time of impact with the substrate the droplets have been sufficiently undercooled to prevent formation of crystalline nuclei on cooling through their glass transition temperature.

14. The method of claim 10, wherein the impacted droplets have cooled sufficiently to remain amorphous prior to being impacted with additional droplets.

15. The method of claim 10, wherein the temperature of the top surface of the substrate and the deposit thereon is maintained at less than the crystallization temperature of the alloy being deposited.

16. The method of claim 10, wherein the atomizing inert gas pressure is about 100 to about 1,000 psi; the metal alloy mass flow rate is about 0.2 to about 2 kg/min.; the metallic substrate is about 20 to 60 cm from the container opening; the metallic substrate has a quench capacity of greater than about 1000° K./sec.

17. The method of claim 10, wherein the deposited alloy is at least about 95% amorphous.

* * * * *